US006035481A

United States Patent [19]

Douglas et al.

[11] Patent Number: 6,035,481

[45] Date of Patent: Mar. 14, 2000

[54] PAINT BRUSH WITH HINGED INVERTED BRISTLE CLAMPING PANEL, REMOVABLE BRISTLE PACK AND PANEL HINGE YIELD MEMBER

[75] Inventors: Terry R. Douglas; Milan Krgovich, both of Surrey, Canada

[73] Assignee: Kwick Clean and Green Ltd., Surrey, Canada

[21] Appl. No.: 09/088,178

[22] Filed: Jun. 1, 1998

[51] Int. Cl.[7] ..... A46B 3/00

[52] U.S. Cl. ..... 15/168; 15/176.6; 15/177; 15/178; 15/193; 15/202; 15/204; 15/DIG. 4

[58] Field of Search ..... 15/146, 147.1, 15/150, 159.1, 168, 169, 171, 176.1, 176.4–176.6, 177, 178, 191.1, 192, 193, 194, 204, 205, DIG. 4

[56] References Cited

U.S. PATENT DOCUMENTS

| | | | |
|---|---|---|---|
| 441,271 | 11/1890 | Williams | 15/178 |
| 568,267 | 9/1896 | McIver et al. | 15/178 |
| 589,052 | 8/1897 | Watts | 15/171 |
| 999,307 | 8/1911 | Holcombe | 15/178 |
| 1,285,195 | 11/1918 | Iker | 15/178 |
| 1,757,650 | 5/1930 | Arico | 15/194 X |
| 2,326,879 | 8/1943 | Neuhasen | 15/202 |
| 4,129,918 | 12/1978 | Lee | 15/169 |
| 4,237,579 | 12/1980 | Salmon | 15/166 |
| 4,339,837 | 7/1982 | Reeberg | 15/169 |
| 5,289,606 | 3/1994 | Ledingham | 15/168 |
| 5,315,733 | 5/1994 | Ledingham | 15/168 |
| 5,435,037 | 7/1995 | Ledingham | 15/168 |

FOREIGN PATENT DOCUMENTS

| | | | |
|---|---|---|---|
| 22754 | 1/1906 | Australia | 15/177 |
| 11-3013 | 4/1952 | France | 15/177 |
| 86377 | 4/1896 | Germany | 15/177 |
| 393254 | 10/1965 | Switzerland | 15/176.1 |

*Primary Examiner*—Mark Spisich
*Attorney, Agent, or Firm*—Lawrence A. Maxham; Baker & Maxham

[57] ABSTRACT

This invention pertains to a novel paint brush with inverted bristle clamping panel, a removable bristle pack and a panel hinge yield mechanism. The paint brush provides ready cleaning after use by disengaging the hinged inverted bristle clamping panel, removing the bristles and thereby exposing all of the bristles to the cleaning solution. The panel has a resilient release mechanism which yields slightly when undue force is applied to the inverted hinged panel against the bristles. A paint brush construction comprising: (a) a paint brush body and handle, the body having formed therein a cavity for receiving a group of bristles; (b) a pivotal bristle bearing member positioned proximate to the cavity, the bristle bearing member when pivoted to a closed position applying a holding force against bristles held within the cavity, and the member when pivoted to an open position enabling bristles held within the cavity to be removed; and (c) a resilient yield location associated with the paint brush body and the pivotal bristle bearing member which enables the pivotal bristle bearing member to yield when the bristle bearing member encounters an undue force when being pivoted to the closed position.

16 Claims, 7 Drawing Sheets

FIG. 6
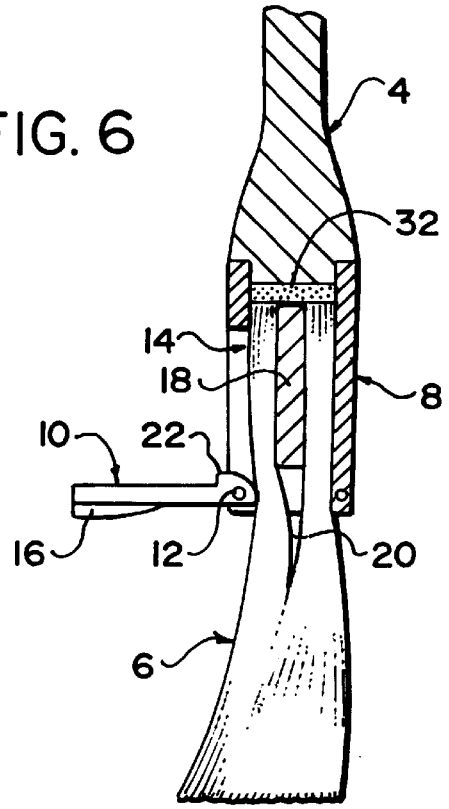
FIG. 7
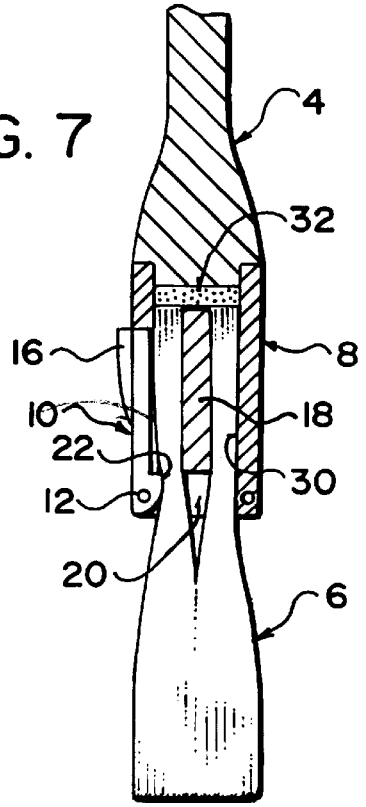
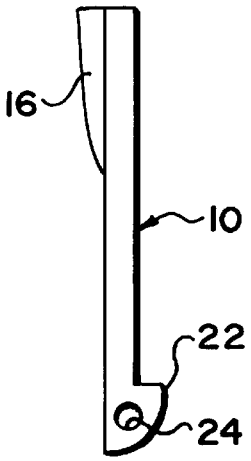
FIG. 8
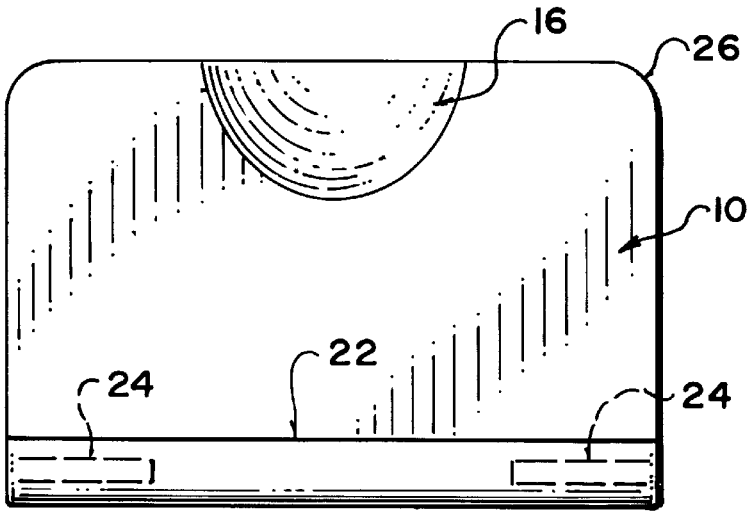
FIG. 9

PAINT BRUSH WITH HINGED INVERTED BRISTLE CLAMPING PANEL, REMOVABLE BRISTLE PACK AND PANEL HINGE YIELD MEMBER

FIELD OF THE INVENTION

This invention pertains to a novel paint brush with inverted bristle clamping panel, a removable bristle pack and a panel hinge yield mechanism. The paint brush provides ready cleaning after use by disengaging the hinged inverted bristle clamping panel, removing the bristles and thereby exposing all of the bristles to the cleaning solution. The panel has a resilient release mechanism which yields slightly when undue force is applied to the inverted hinged panel against the bristles.

BACKGROUND OF THE INVENTION

A longstanding problem with paint brushes that are used for industrial and domestic painting applications is that with time and repeated use, paint tends to build up within the bristles of the brush in the region where the bristles are held by the ferrule clamp that joins the bristles with the paint brush handle and base. The collected paint in this confined area is difficult to clean away. Usually, some residual paint is left in the bristles at the junction with the ferrule even after the used brush has been cleaned. The dried paint at this location collects and builds up over time with repeated use of the paint brush. This causes the bristles of the brush to spread and thereby reduces the efficiency of the brush. Also, the build up of dried paint tends to cause the bristles to wear and break at the location of the dried paint. This reduces the life of the paint brush.

Proper cleaning of a paint brush requires a considerable amount of solvent, if the person cleaning the brush is meticulous. If the paint has a water base, large amounts of water are wasted attempting to thoroughly clean the brush. If the paint is an oil base paint, then expensive petroleum paint solvent or thinner is required for cleaning. The use of a petroleum base solvent constitutes a waste of costly solvent and at the same time creates an environmental pollutant. Most commercial painters will tend to minimize costs by balancing the amount of the solvent used with the number of times the paint brush is used. It may be economic, for instance, to only expect a paint brush to be used a half-dozen times before it must be discarded, rather than incur the cost and waste a considerable amount of solvent attempting to meticulously clean the brush after each use, and prolong the life of the paint brush.

It would be advantageous if a paint brush could be designed which would minimize or eliminate the build up of paint in the location where the bristles are set or meet the paint brush handle. It would also be useful if a mechanism could be developed to reduce the amount of solvent which is required to clean a paint brush. It would also be advantageous if the bristles could be readily removed from the paint brush handle, for cleaning, and the clean bristles reinstalled in the handle for further painting. It would also be advantageous if the mechanism holding the bristles was resistant to breakage.

U.S. Pat. No. 5,289,606, issued Mar. 1, 1994, to Blake A. Ledingham, discloses a unitary paint brush which comprises a paint brush body attached to a handle. The body defines a cavity adapted for receiving a group of bristles. A pair of hinged releasable flaps project over the cavity to abut the bristles when moved to a closed position. The bristles are released by moving the flaps into an open position. The hinged flaps are held in place on the bristle pack base by springs which can be rotated from a flap open position to a flap closed position, and vice versa. A problem with the springs is that they are a separate component, are cumbersome and raise manufacturing expense.

U.S. Pat. No. 5,315,733, granted May 31, 1994, Blake A. Ledingham, discloses a paint brush bristle clamp which can be applied over the ferrule and part of the bristles of a paint brush before use, and which deters paint from migrating from the free end of the bristles to the ferrule. The clamp is removed after the brush is used so that the bristles at the ferrule are exposed. The bristles are easy to clean after the clamp is removed.

U.S. Pat. No. 4,129,918, granted Dec. 19, 1978, to Robert Lee, discloses an adjustable sleeve for an artist's paint brush adapted to adjust the effective length of the bristles of the brush. The adjustable sleeve is tubular at its tip to contain the hair or bristles. The sleeve is split above the tip to provide a spring biased grip upon the brush ferrule. The adjustable sleeve is tapered in substantial conformity with the taper of the ferrule and it is longitudinally adjustable relative to the ferrule to vary the effective length of the hair or bristles. The sleeve is designed for use with an artist's brush, which has bristles arranged in a taper column form. The sleeve does not fit over the base of the brush at the location where the bristles meet the base.

U.S. Pat. No. 4,237,579, issued Dec. 9, 1980, to Jonathan H. Salmon, discloses a tool for applying a liquid stain to a flat surface to impart a timber grain effect to the surface. The tool comprises a paint brush, a bristle retaining slidable plate on one side of the brush and a slidable comb plate on the other side of the brush. Both of the plates have an elongated slot which engages a bolt which passes through the paint brush. The comb adjustably separates the brush bristles into discrete bunches to permit the application of stain to impart a wood grain pattern to the surface. This tool does not disclose a holder which fits on both sides of the paint brush base where the bristles are secured to the base. The tool is not designed to prevent paint from migrating down the bristles in the direction of the base.

U.S. Pat. No. 4,339,837, granted Jul. 20, 1982, to Christiaan Reeberg, discloses a sliding box-like girdle which fits over a paint brush to confine the bristles. The girdle acts as a hanger so that the paint brush can be hung on a wall. The girdle also protects the brush bristles while on display, or during storage. Further, the girdle is used to control the effective length of the bristle ends for specific painting jobs. The girdle also serves to squeeze excess paint from the bristles after each dip into a can of paint. The girdle does not serve to encircle the base of the paint brush, where the bristles meet the paint base, and thereby prevent paint from migrating along the bristles to the base, and thereby collecting at the base-bristle ended face.

SUMMARY OF THE INVENTION

The invention is directed to a paint brush construction comprising: (a) a paint brush body and handle, the body having formed therein a cavity for receiving a group of bristles; (b) a pivotal bristle bearing member positioned proximate to the cavity, the bristle bearing member when pivoted to a closed position applying a holding force against bristles held within the cavity, and the member when pivoted to an open position enabling bristles held within the cavity to be removed; and (c) a resilient yield location associated with the paint brush body and the pivotal bristle bearing member which enables the pivotal bristle bearing member to yield when the bristle bearing member encounters an undue force when being pivoted to the closed position.

The paint brush can include a group of parallel bristles held within the cavity, with a glue cap at one end of the bristles held within the cavity and free ends of the bristles extending from the interior of the cavity. The pivotal bristle bearing member can be a panel which can have a planar configuration and can pivot about a resilient hinge. The pivotal bristle bearing member can pivot about the end of the paint brush body opposite the handle.

The panel can have formed on a bristle bearing side thereof, a protrusion which can extend across the width of the cavity, so that when the panel is pivoted to a closed position, the protrusion can apply a holding force against the bristles in the interior of the cavity, and when the panel is pivoted to an open position, the protrusion can move away from the bristles. The protrusion can be shaped so that it has an increasing radius from a pivot point which can cause the protrusion to apply an increasing compression force against the bristles when the panel is pivoted from an open position to a closed position.

The resilient yield location can be a resilient hinge which can pivotally connect the bristle bearing member to the paint brush body. The resilient hinge can be a pair of springs which can be located on opposite sides of the paint brush body. The pair of springs can have a V-shaped central body, with free ends extending from the central body. The resilient hinge can have a base, a pair of V-shaped wings extending from each end of the base and a pair of free ends extending from the respective ends of the wings opposite the base.

The resilient yield location can be one or more slots formed in the paint brush body.

The bristle bearing member can be a panel which can be pivotally connected by the resilient hinge to each side of the paint brush body at an end opposite the handle.

The invention is also directed to a paint brush construction comprising: (a) a paint brush body and handle, the body providing a cavity for receiving one end of a pack of parallel bristles; (b) a pack of parallel bristles with the one end of the bristles held in the cavity; (c) a pivotal bristle bearing member which has a protrusion on a bristle proximate side thereof, the protrusion applying a force against the pack of bristles when in a first closed position, the protrusion withdrawing from applying a force to the pack of bristles when in a second open position; and (d) a resilient spring associated with the body for enabling the pivotal member to be reciprocally and yieldingly pivoted from a first closed position to a second open position.

DRAWINGS

In the drawings which represent a detailed illustration of specific embodiments of the invention, but which should not be construed as limiting the scope of the invention in any way:

FIG. 6 illustrates a side section-view of the bristle holder paint brush with the hinged inverted side bristle gripping panel half-opened away from the bristles.

FIG. 7 illustrates a side section-view of the bristle holder paint brush with the hinged inverted side bristle gripping panel closed against the bristles.

FIG. 8 illustrates a side view of the inverted bristle gripping panel of the paint brush.

FIG. 9 illustrates a front view of the inverted bristle gripping panel.

DETAILED DESCRIPTION OF SPECIFIC EMBODIMENTS OF THE INVENTION

Unlike conventional paint brushes, which typically are constructed of a wooden handle, a ferrule, a bristle separating member, nails, and bristles, the main components of the paint brush bristle holder according to the invention are formed of four pieces, namely a handle connected to a bristle holder girdle base to form one piece, a hinged inverted bristle gripping panel, a removable bristle pack, and a panel pressure yield spring. The panel pressure yield spring hinges the gripping panel to the bristle holder, and enables the panel to be pivoted from a fully closed to fully open position relative to the holder and the bristle pack. The yield spring also enables the inverted bristle gripping panel to yield when an undue force is applied to the panel, thereby preventing breakage of the panel hinge.

Figure 1:
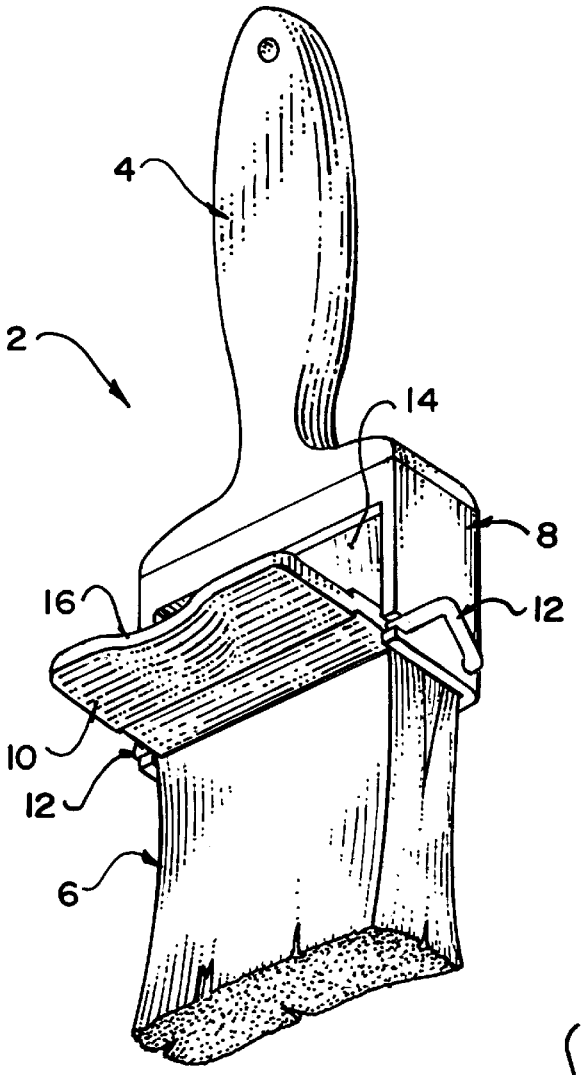
FIG. 1 illustrates an isometric view of a paint brush with a hinged inverted bristle clamping panel in a half-open position, removable bristle pack and panel pressure yield spring.

FIG. 1 illustrates an isometric view of a paint brush with a hinged inverted bristle clamping panel in a half-open position, removable bristle pack and panel pressure yield spring. Specifically, the paint brush 2 comprises a handle 4, a removable bristle pack 6, the top end of which is held in place inside a bristle holder 8 connected to the handle 4. A hinged inverted bristle panel 10 at one end is yieldingly held in place in a pivotal manner at the front base of the holder 8 by a panel pressure yield spring 12. While not visible in FIG. 1, there is a corresponding yield spring hingedly holding the opposite end of the panel 10. Immediately behind the hinge panel 10 is a cavity 14 which, as seen in FIG. 1, exposes the proximate side of the bristles 6. To assist in gripping the inverted panel 10, a curved finger grip 16 is formed in the middle of the free side of the hinged panel 10 opposite the spring 12. The panel design shown in FIG. 1 has a bristle bearing ridge on the interior side which enables the bristle facing side of the panel 10 to close against and securely grip the bristles 6 when the panel 10 is in a closed (upright) position.

Figure 2:
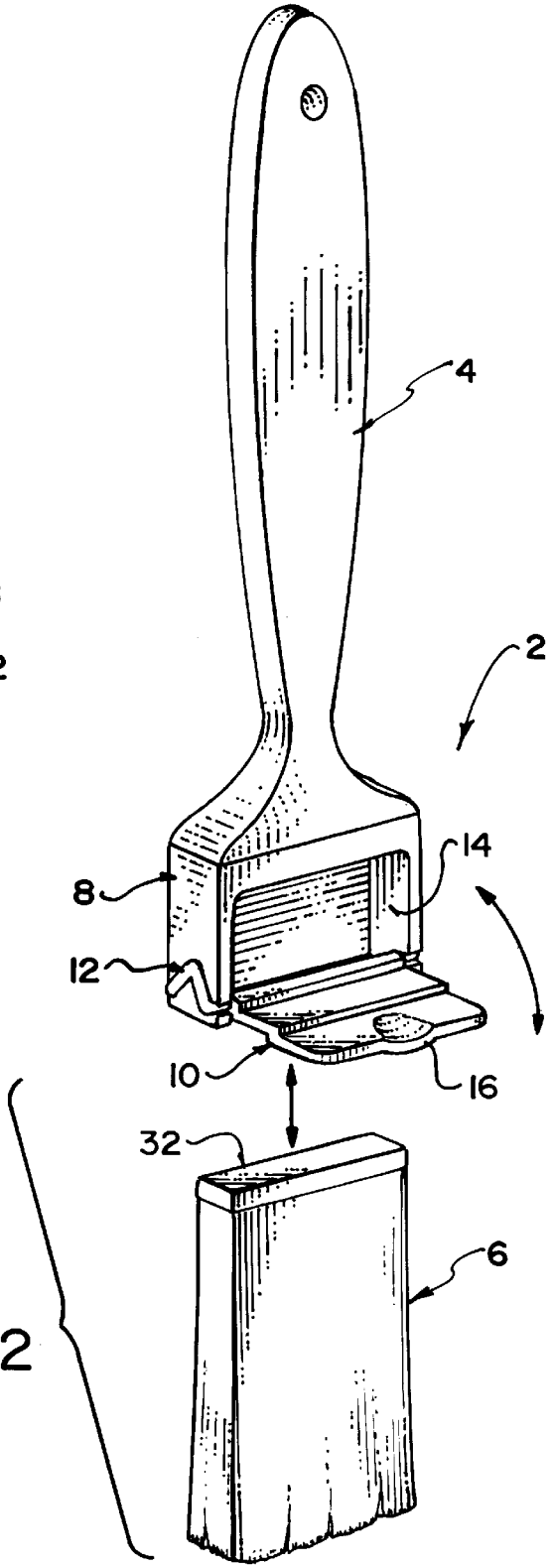
FIG. 2 illustrates an isometric exploded view of the paint brush with a hinged inverted bristle clamping panel in half-open position and the bristle pack removed.

FIG. 2 illustrates an isometric exploded view of the paint brush with a bristle clamping panel 10 and the bristle pack 6 removed. Specifically, as seen in FIG. 2, the handle 4 has the bristle holder 8 affixed to its base. The bristle pack 6, as seen in FIG. 2, has been downwardly withdrawn from the interior of the holder 8. The bristle pack 6 is fully exposed and the entire bristle pack 6 can be readily cleaned when removed from within the holder 8. The top ends of the bristles 6 (which fit within the holder 8) are held together by a thick base layer of glue 32. When the bristle pack 6 is inserted inside the interior of the holder 8, the glue base 32 fits inside the top end of the cavity 14 in the holder 8 and abuts the base of the handle 4 inside the holder 8.

FIG. 2 also illustrates the inverted hinge panel 10 in a half-open position, extending horizontally from the holder 8, and pivoted about yield spring 12. A corresponding matching spring 12 is located on the opposite side of the holder 8, although it is not visible in FIG. 2. The finger grip 16 enables the user to easily grip the top of panel 10 and push it downwardly, thereby releasing the bristle pack 6. The inverted panel 10 facilitates release of the bristle pack 6 because the paint brush user can grip the handle 4 and use his or her thumb to contact grip 16 and push the panel 10 open. The inverted panel 10, when pivoted away from the holder 8, exposes the cavity 14 thereunder as seen in FIG. 2. The cavity 14 can be cleaned if necessary.

Figure 3:
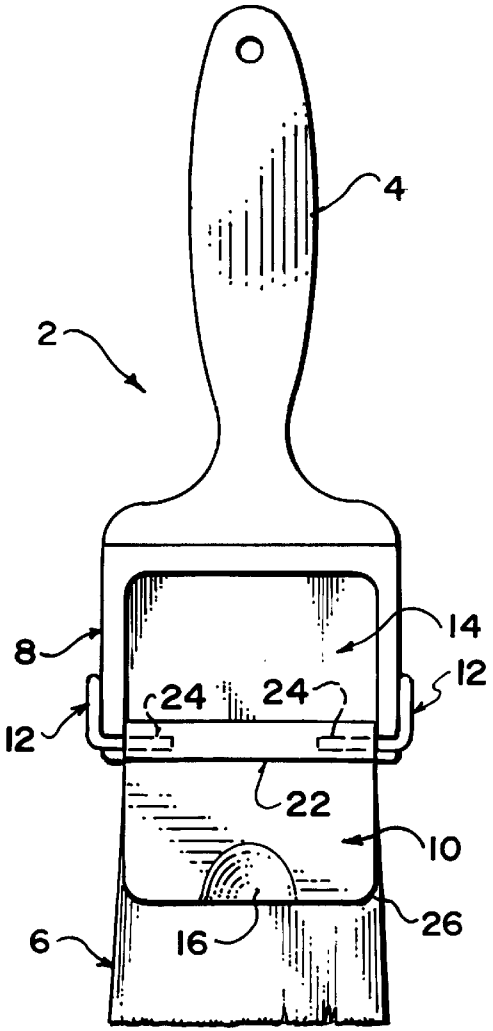
FIG. 3 illustrates a front view of the paint brush with an inverted clamping panel fully opened to a lowered position exposing one side of the bristles inside the bristle cavity of the paint brush.

FIG. 3 illustrates a front view of the paint brush with the inverted clamping panel 10 fully opened to a lower position exposing the bristles 6 inside. As seen in FIG. 3, the panel 10, with finger grip 16, is in a fully opened and fully lowered vertical position, thereby fully exposing the cavity 14. If the removable bristle pack 6 becomes stuck inside the holder 8 for any reason, such as by dried paint, it can be pried loose by a suitable instrument such as a screwdriver. The panel 10 has rounded corners 26 so that potentially hazardous sharp edges on the panel 10 are avoided. When the panel 10 is in the fully opened lowermost position illustrated in FIG. 3, there is no force applied to the bristle pack 6 and the bristle pack 6 can be easily removed from the interior of the holder 8 (see FIG. 2).

Figure 4:
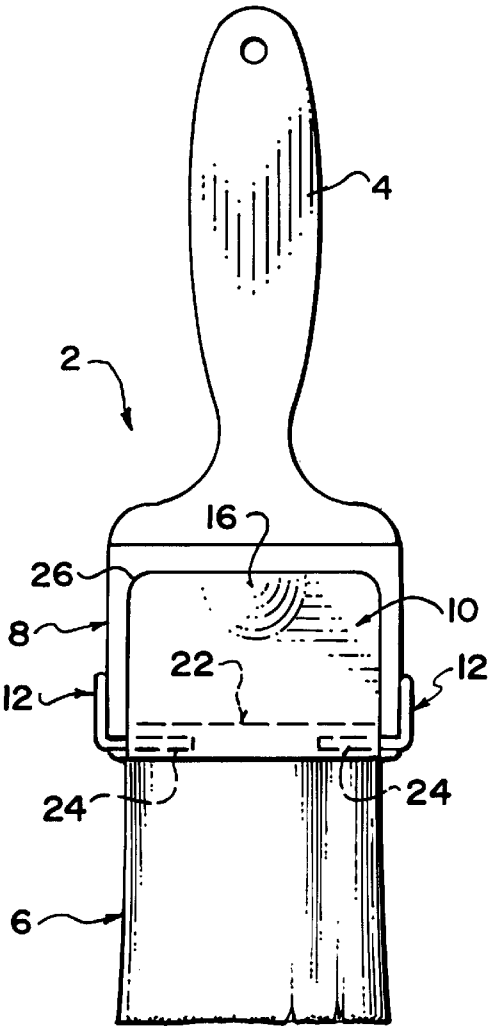
FIG. 4 illustrates a front view of the paint brush with the inverted clamping panel closed in an uppermost position hiding the removable bristles inside the bristle holder of the paint brush.

FIG. 4 illustrates a front view of the paint brush 2 with the inverted clamp panel 10 raised to a closed uppermost position, thereby completely covering the cavity 14 of the paint brush and the top portion of the bristles 6. When the panel 10 is in the uppermost position as illustrated in FIG. 4, the bristle wedge edge 22 (shown in dotted lines) (see FIG. 8 as well) is fully pressed against the underlying bristles 6, and securely holds the bristles 6 in place within the holder 8, and also prevents the migration of paint past the line where the edge 22 bears on the bristles 6, as will be explained in more detail below.

Figure 5:
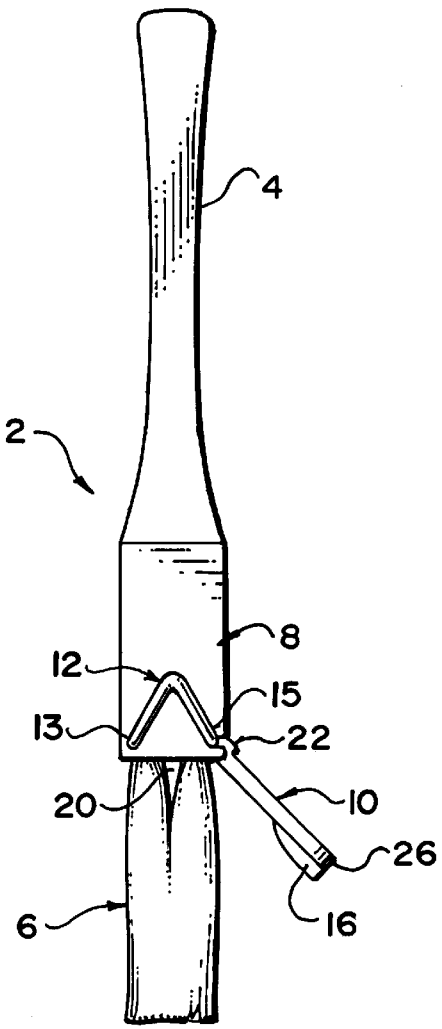
FIG. 5 illustrates a side view of the paint brush with the panel pressure yield spring on the side and hinged inverted gripping panel three-quarter opened to a lowermost position.

FIG. 5 illustrates a side view of the paint brush, with the V-shape panel pressure yield spring 12 on the side of the holder 8 and the inverted gripping panel 10 open to about three-quarters of its fully opened position. The panel 10, with finger grips 16, is hinged on and pivots about the free ends of the pair of panel pressure yield springs 12 (only one of which is visible in FIG. 5). The rear parts of each of the springs 12 extend into snug recesses found in the back of the holder 8 at each side. FIG. 5 also clearly illustrates the bristle compressing wedge edge 22, formed in the portion of the panel 10, adjacent the hinge spring 12, and a brush stroke facilitating, and paint holding bristle gap 20, which is normally formed in the bristle pack 6, as is conventional in the paint brush industry. The bristle gap 20 normally allows the bristles to hold more paint and gives the brush a superior brush stroke feel.

FIG. 6 illustrates a side section view of the bristle holder paint brush with the hinged inverted side bristle gripping panel half-opened away from the bristles 6 by means of finger grip 16. The inverted panel 10 pivots about the pair of yieldable hinge springs 12 (one of which is shown in FIG. 5). The design of the bristle wedge edge 22 is fully illustrated in FIG. 6. It has an increasing-radius curved configuration so that as panel 10 is pivoted upwardly to a closed position, the curved wedge design of bristle wedge edge 12 applies an increasing force against the adjacent portion of the bristles 6. This action squeezes the bristles 6 at the abutting location of the wedge 22 and prevents paint from migrating upwardly from the free lower end of the bristles 6 into the interior of the holder 8. FIG. 6 also illustrates a bristle separator 18, which is positioned in the top interior portion of the bristles 6 and creates bristle gap 20 below the bristle separator 18 and the glue base 32 at the top of the bristle pack 6. The bottom edge of the bristle separator 18 is preferably higher than the compression location of the wedge 22 on the bristles 6. Thus gripping action on the bristles 6 is enhanced because the wedge 22 squeezes the bristles 6 around the base of the separator 18. While not shown fully in FIG. 6, the V-shape resilient yield spring 12 (shown in section) enables the panel 10 to move slightly away from the bristle 6, and hence prevent hinge breakage if there is some obstruction such as dried paint, or an improperly installed bristle pack 6, that prevents the panel 10 from closing properly. As can be recognized, the mechanical advantage of the panel 10 on the pressure wedge 22 is very large and it is not difficult to break the panel 10 by exerting undue pivoting force on the panel 10.

FIG. 7 illustrates a side section view of the bristle holder paint brush with the hinged inverted side bristle gripping panel 10 fully closed against the bristles 6. When the hinge panel 10 has been fully raised to its upper closed position, as seen in FIG. 7, the panel 10 fully covers cavity 14 (see FIG. 3) and the bristle wedge edge 22 is fully forced against the bristles 6 in the region adjacent resilient hinge spring 12 (shown in section). Edge 22 thereby applies a force which is transmitted across the entire width of the group of bristles 6 and immediately below the base of the bristle separator 18. Locating the pressure line immediately below the base of the bristle separator 18 assists in holding the bristles 6 in place. In this pressure-line configuration, paint, which is held by the lower free portion of the bristles 6 in the typically painting configuration, is prevented from migrating by capillary action upwardly past the pressure-line into the interior of the holder 8. The horizontal force applied by wedge edge 22 can in some cases cause the bristle pack 6 to deform inwardly on the proximate side (to the right as seen in FIGS. 6 and 7). Thus the bristles 6 may not project entirely straight (in line) from the handle 4 and holder 8. This tendency of the bristles 6 to angle can be offset by appropriately angling the interior back side of the cavity of the holder 8.

FIG. 8 illustrates a side view of the inverted hinge bristle gripping panel 10 of the paint brush. As seen in this enlarged side view, the planar bristle panel 10 is constructed so that it has at the top portion thereof a curved finger grip 16, which enables the top end of the panel 10 to be easily gripped by a finger of the user while still holding the handle 4. The lower end of the panel 10 is constructed so that it has first and second yield spring tip holes 24 extending into each respective side of the panel in the region of the bristle wedge edge 22. (This is more clearly illustrated in FIG. 9.) The curved face of the bristle wedge edge 22 is designed with an increasing radius so that as panel 10 is pivoted to a closed (upward) position about hinge spring 12, the two free ends of which are received in the two spring holes 24, the curved face of the wedge edge 22 applies a gradually increasing bearing force against the side of the bristles 6 (not shown in FIG. 8, but see FIGS. 6 and 7). This action occurs as panel 10 is raised from a fully open to a fully closed position, as illustrated in FIGS. 3 through 7.

Figure 12:
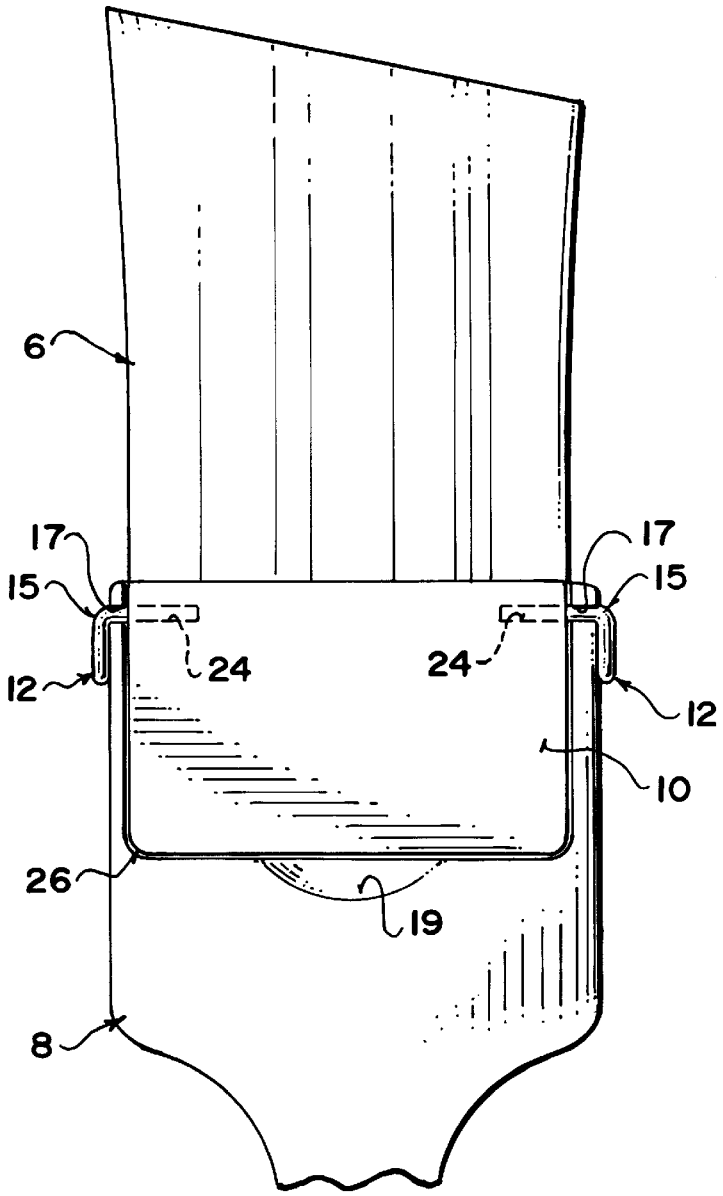
FIG. 12 illustrates a front view of a paint brush with an angle-tipped removable bristle pack, a hinged front inverted bristle holding panel and panel pressure yield spring.
Figures 14, 15:
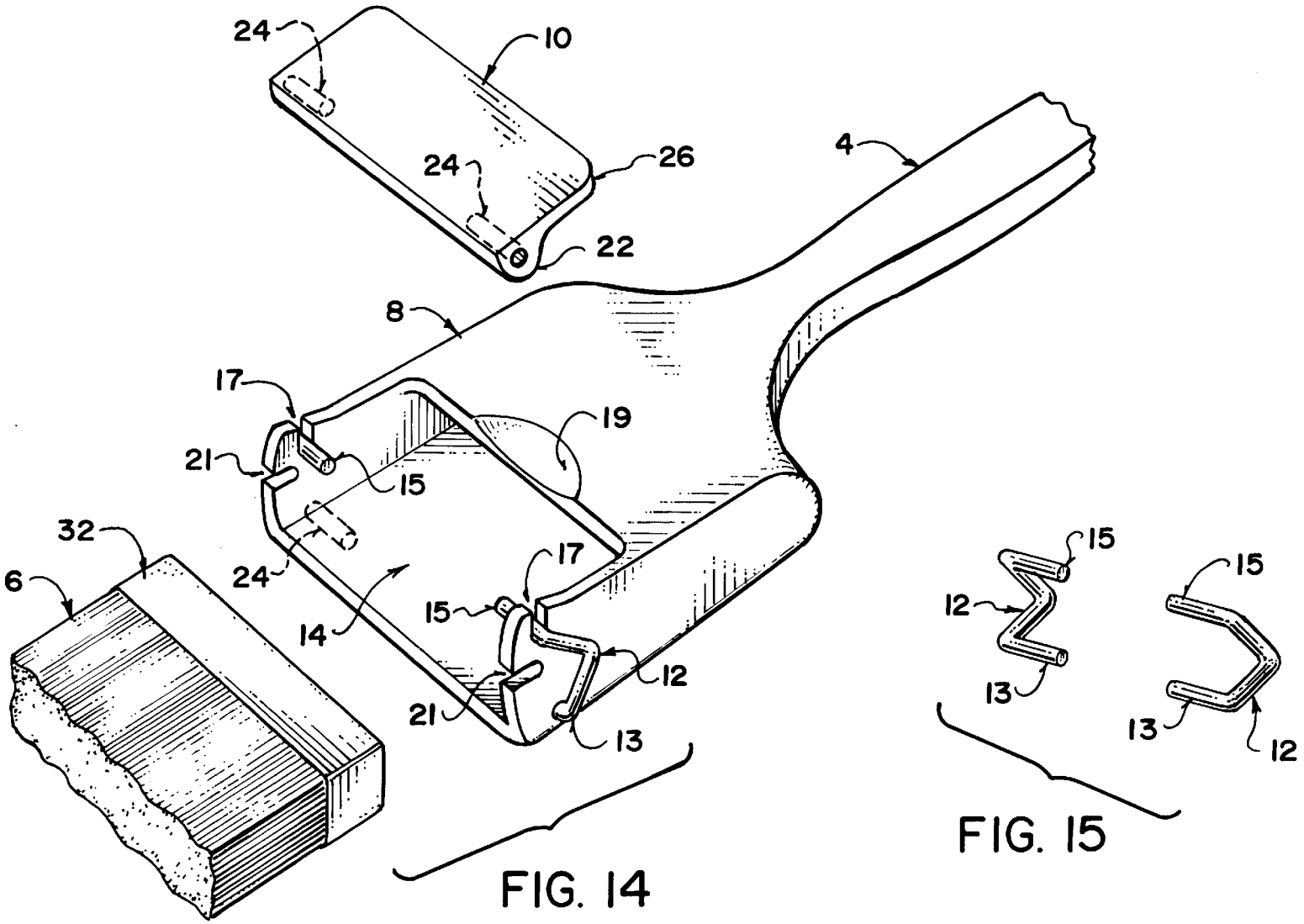
FIG. 14 illustrates an exploded isometric view of the paint brush with hinged inverted panel, bristle pack and panel pressure yield spring.
FIG. 15 illustrates an isometric view of a pair of panel pressure yield springs.

FIG. 9 illustrates a front view of the inverted bristle gripping panel 10. In this enlarged view of the inverted bristle panel 10, the ergonomically designed curved concave shape of the finger grip 16 is illustrated. This curved configuration readily fits the fingertip of a user. Alternatively, the panel 10 can be entirely planar, and the finger grip can be formed by a recess 19 in the front face of the holder 8 as seen in FIGS. 12 and 14. The rounded upper corners 26 of the panel 10 ensure that no potentially hazardous sharp edges, which can cause cuts and problems to the user, are exposed. The two spring holes 24, which extend from each side into the base of panel 10, are shown in dotted lines in FIG. 9. These two spring holes receive the respective free ends of a pair of yield springs 12, as seen best in FIG. 4. The upper edge of bristle wedge edge 22 is also illustrated in FIG. 9.

Figure 10:
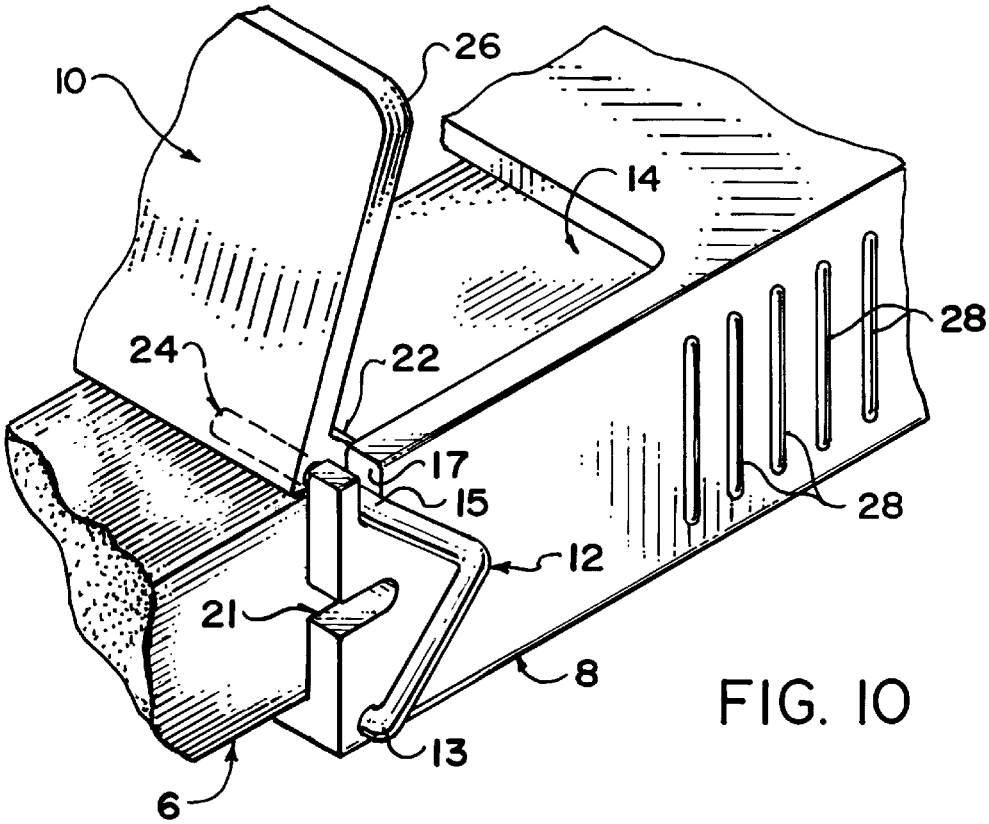
FIG. 10 illustrates an enlarged isometric view of a portion of the bristle holder with the hinged inverted gripping panel in a partially open position, and the panel pressure yield spring on the side.

FIG. 10 illustrates an enlarged isometric view of a portion of the bristle holder 8 with the gripping panel 10 in a partially open position and the panel pressure yield spring 12 on the side. This enlarged view, as illustrated in FIG. 10, shows clearly how the resilient V-shape panel pressure yield spring 12 fits on the side of the holder 8, with the rear free end 13 (bottom as seen in FIG. 10) extending into the interior of the base of the holder 8, while the free front prong end 15 fits through slot 17 in the front face of the holder 8. A portion of the bristle abutting wedge edge 22 of panel 10 is also visible. FIG. 10 also illustrates an optional slot 21 which can be formed in the end of the holder 8. This slot 21 enables the end of the holder 8 to spread slightly when a large force is applied to the panel 10 and enhances the yield capability. The end of the slot 21 is curved to deter splitting of the holder 8.

FIG. 10 also illustrates optional finger ribs 28, which can be formed in the sides of the holder 8, to enhance grippability of the paint brush 2 and holder 8. The cavity 14, which underlies the panel 10, and exposes the proximate area of the bristles 6, is also illustrated in FIG. 10.

The purpose and function of resilient V-shape panel pressure yield spring 12, and slot 17 in the front face of holder 8 is to permit some "give" in case the bristle pack 6 is not properly installed in the cavity 14 (for example, if the hard glue base 32 is not fully pushed into the cavity, or if there is some obstruction in the cavity, or the bristles 6 have swelled with use) and an undue force would be applied to the panel 10 in order to close it against the bristles 6. This prevents the hinge mechanism from being broken, which has been a problem with prior designs of paint brushes with fixed hinge pins. The slot 21, which is optional, adds further yield capability to the holder 8, panel 10 combination.

Figure 11:
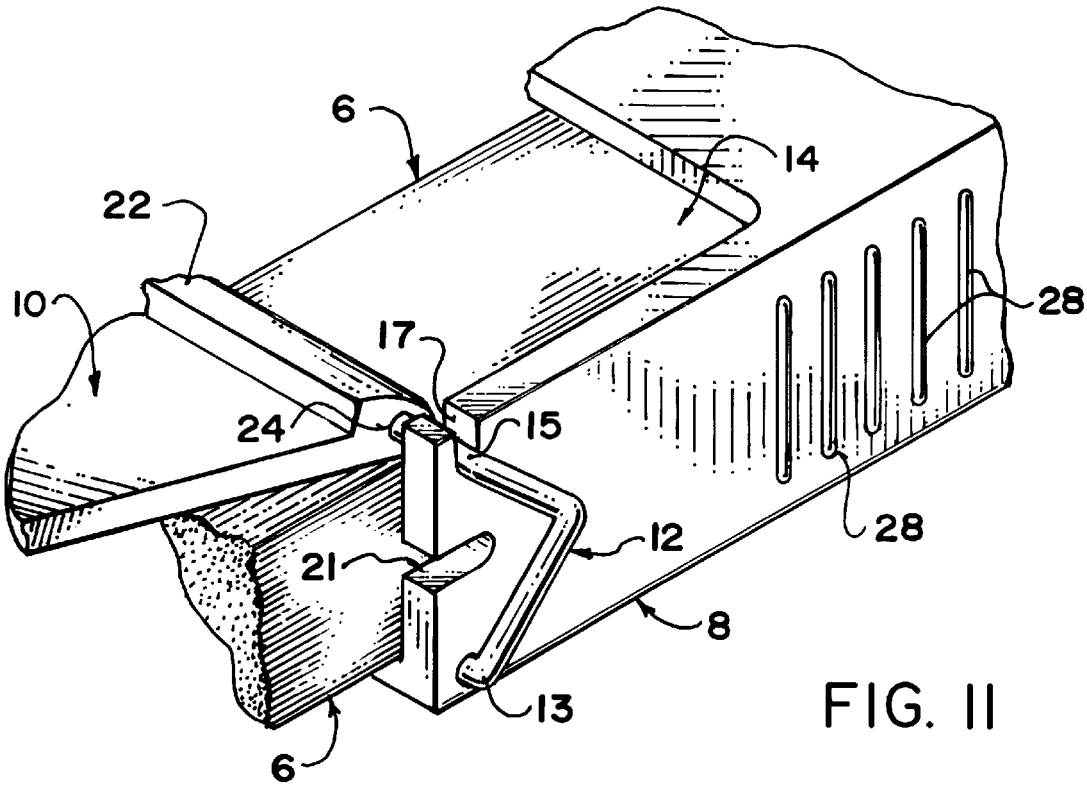
FIG. 11 illustrates an enlarged isometric view of a portion of the bristle holder with the hinged inverted gripping panel in a fully open position exposing the underlying bristles in the cavity, and the panel pressure yield spring on the side.

FIG. 11 illustrates an enlarged isometric view of a portion of the bristle holder 8 with the gripping panel 10 in a virtually fully opened position exposing the underlying bristles 6. When the panel 10 is in the virtually fully opened position as illustrated in FIG. 11, the bristle wedge edge 22 has been fully withdrawn from the underlying bristles 6. Thus bristle pack 6 can be readily withdrawn from the interior of the holder 8, as illustrated above in FIG. 2. The cavity 14 can be cleaned if required.

FIG. 12 illustrates a front view of a paint brush with an angle-tipped removable bristle pack 6, and a pair of panel pressure yield springs 12. As seen in FIG. 12, the finger recess 19 is formed in the front face of holder 8 rather than in the panel 10. There is thus no protruding finger grip 16 in the free end of the panel 10. Also, as seen in FIG. 12, the pair of V-shaped resilient panel pressure yield springs 12 fit on each side of the holder 8, with the two free prong ends 15 extending through the slots 17 and into the respective sides of panel 10, as shown by dotted lines 24.

Figure 13:
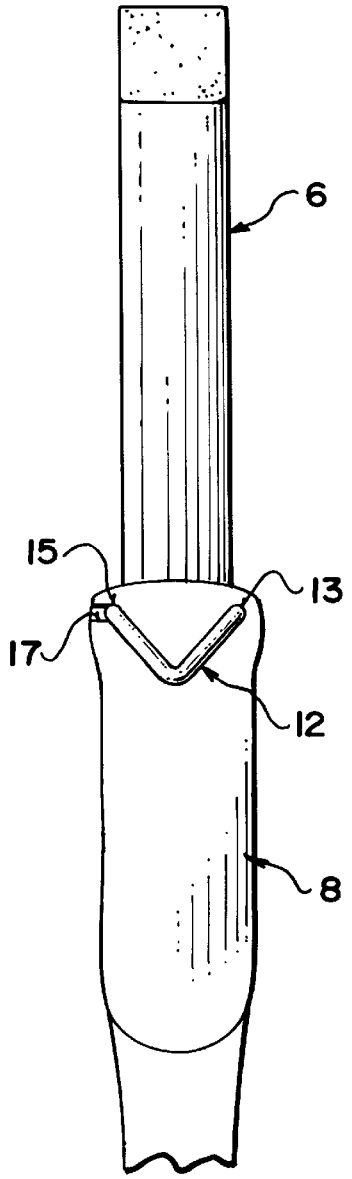
FIG. 13 illustrates a side view of a paint brush with an angle-tipped removable bristle pack, and panel pressure yield spring.

FIG. 13 illustrates a side view of a paint brush with an angle-tipped removable bristle pack 6, and panel pressure yield spring 12. As seen in FIG. 13, the resilient V-shaped pressure yield spring 12 has a free prong end 15 at the panel side, which fits through slot 17 and into the hole 24 in the panel 10 (see FIG. 12), while the free base end 13 of the spring 12 extends into a hole in the rear side of holder 8. FIG. 13, in particular, shows how the free front prong end 15 of the yield spring 12 will yield to the left in slot 17, if undue force is applied to the panel 8 (not visible) when closing it on bristles 6. If the resilient V-shape pressure yield spring 12 is not present, and a permanent stationary unyielding hinge pin is used instead, the pin would break whenever undue force was applied to the panel 10 when attempting to close it fully against the bristles 6.

FIG. 14 illustrates an exploded isometric view of the paint brush 4 with removed inverted hinged panel 10, removed bristle pack 6 and the pair of panel pressure yield springs 12 installed on each side of the holder 8. FIG. 14, in particular, illustrates how the resilient V-shaped pressure yield spring 12 fits into holes in the two sides of the holder 8. The free end base 13 of the front yield spring 12 penetrates into a hole 24 in the rear side of holder 8. The two forward prong ends 15 of the pair of springs 12 fit in respective slots 17 found in the front edges of the two sides of the holder 8. The two openings 24 in panel 10 receive the two free prong ends 15 of the pair of springs 12 to provide a yieldable hinge mechanism.

FIG. 14 also illustrates a pair of optional slots 21 which are formed in the front (bottom) faces of the two sides of the holder 8. These slots 21 provide a further "yield location" for the paint brush 2 if undue force is applied in closing the panel 10. The ends of the slots 21 should be rounded to deter splitting of the holder 8.

FIG. 15 illustrates an isometric view of a pair of panel pressure yield springs 12. Each of the pair of springs has a base free end 13 and a front free end 15. It will be recognized that the shape of the sides of the springs 12 need not necessarily be "V-shaped". The body of the springs may be curved. The shape should be such that a yield mechanism between the free end 15 and the base end 13 is provided.

Figures 16, 17, 18:
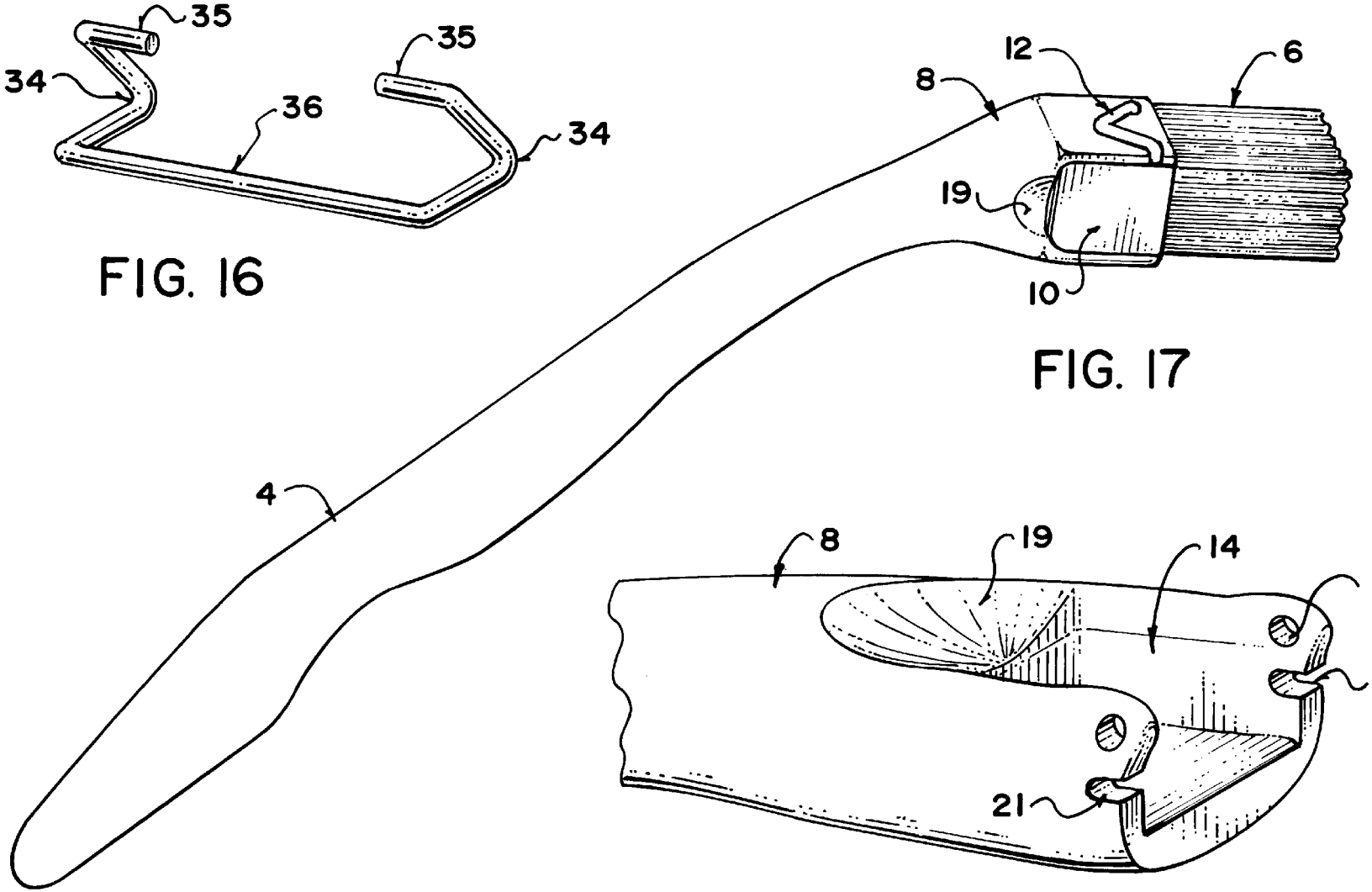
FIG. 16 illustrates an isometric view of an alternative embodiment of panel pressure yield spring, with connecting base.
FIG. 17 illustrates an isometric view of a barbecue-style brush with hinged inverted clamping panel, removable bristle pack and panel pressure yield spring.
FIG. 18 illustrates an enlarged isometric view of the bristle holding tip of the barbecue-style brush of FIG. 17.

FIG. 16 illustrates an isometric view of an alternative embodiment of the panel pressure yield spring 34. This embodiment of spring 34 has a pair of V-shaped sides, connecting to a pair of frontal free prong ends 35 and a single connecting base 36 which is parallel to the two ends 35. When this design of spring 34 is used, the base 36 extends across the back of the cavity 14. Alternatively, a channel can be formed across the rear face of the interior of the holder 8 to receive the base 36. A possible advantage of this design of spring 34 is that being one piece, there is no danger that one or both of the V-shaped ends may come loose.

FIG. 17 illustrates an isometric view of a barbecue-style brush with hinged clamping panel 10, removable bristle pack 6 and a pair of panel pressure yield springs 12 (only one of which is visible). A finger recess 19 is formed in the front face of the holder 8. The barbecue-style brush has a curved ergonomically shaped handle 4, which is easily held in the hand, and which enables the bristles 6 to penetrate corners. FIG. 18 illustrates an enlarged isometric view of the bristle holding tip 8 of the barbecue-style brush of FIG. 17. A pair of slots 21 can be formed in the front ends of the two sides of the holder to provide additional yield.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A paint brush construction comprising:

(a) a paint brush body and handle, the body having formed therein a cavity for receiving a group of bristles;

(b) a bristle bearing member positioned proximate to the cavity having a bristle engaging portion and a pivot point at the bristle engaging portion, the pivot point being at the end of the body remote from the handle wherein:

(i) the bristle bearing member, when pivoted to a closed position, applies a holding force against bristles held within the cavity, and the bristle bearing member, when pivoted to an open position, enables bristles held within the cavity to be removed; and (ii) the pivot point is connected to at least one resilient spring so that the pivot point may move or yield when the bristle engaging portion encounters an undue force.

2. A paint brush as claimed in claim 1 wherein the pivot point is at a slot in the end of the paint brush body.

3. A paint brush as claimed in claim 1 including a group of parallel bristles held within the cavity, with a glue cap at one end of the bristles held within the cavity and free ends of the bristles extending from the interior of the cavity.

4. A paint brush as claimed in claim 1 wherein the bristle bearing member is a panel pivotally connected to the body.

5. A paint brush as claimed in claim 4 wherein the bristle engaging portion is a protrusion formed on a bristle bearing side of the panel, the protrusion extends across the width of the cavity, so that when the panel is pivoted to the closed position, the protrusion applies a holding force against the bristles in the interior of the cavity, and when the panel is pivoted to the open position, the protrusion moves away from the bristles.

6. A paint brush as claimed in claim 5 wherein the protrusion is shaped so that it has an increasing radius from the pivot point which causes the protrusion to apply an increasing compression force against the bristles when the panel is pivoted from the open position to the closed position.

7. A paint brush as claimed in claim 1 wherein the at least one resilient spring is a pair of resilient springs which are located on opposite sides of the body.

8. A paint brush as claimed in claim 7 wherein each of the pair of resilient springs has a V-shaped central body, with free ends extending from the central body.

9. A paint brush as claimed in claim 1 wherein the at least one resilient spring is one resilient spring having a base, a pair of V-shaped wings extending from each end of the base and a pair of free ends extending from the respective ends of the wings opposite the base.

10. A paint brush as claimed in claim 1 wherein the bristle bearing member is a panel which is pivotally connected by the at least one resilient spring to each side of the body.

11. A paint brush construction comprising:

(a) a paint brush body and handle, the body providing a cavity for receiving one end of a pack of parallel bristles;

(b) a pack of parallel bristles with the one end of the bristles held in the cavity;

(c) a bristle bearing member which has a protrusion on a bristle proximate side thereof and a pivot point at the protrusion, the pivot point being at the end of the body remote from the handle;

(d) a resilient hinge associated with the body for enabling the bristle bearing member to be reciprocally and yieldingly pivoted from a first closed position to a second open position wherein:

(i) the protrusion applies a force against the pack of bristles when in the first closed position, the protrusion withdrawing from applying a force to the pack of bristles when in the second open position; and (ii) the pivot point is connected to the hinge so that the pivot point may move or yield when the protrusion encounters an undue force.

12. A paint brush as claimed in claim 11 wherein the resilient hinge is a pair of springs which are located on opposite sides of the body.

13. A paint brush as claimed in claim 12 wherein each of the pair of springs has a V-shaped central body, with free ends extending from the central body.

14. A paint brush as claimed in claim 11 wherein the resilient hinge has a base, a pair of V-shaped wings extending from each end of the base and a pair of free ends extending from the respective ends of the wings opposite the base.

15. A paint brush as claimed in claim 11 wherein the bristle bearing member is a panel which is pivotally connected by the resilient hinge to each side of the paint brush body.

16. A paint brush as claimed in claim 11 including a yield slot in the paint brush body proximate to the resilient hinge.

* * * * *